US005868310A

United States Patent [19]

Leszczynski

[11] Patent Number: 5,868,310

[45] Date of Patent: Feb. 9, 1999

[54] BEVERAGE CONTAINER HOLDER AND METHOD OF FORMING

[76] Inventor: Tomas Leszczynski, 76 Laurel Hill Rd., Crugers, N.Y. 10521

[21] Appl. No.: 939,094

[22] Filed: Sep. 26, 1997

[51] Int. Cl.[6] ..... B65D 3/00

[52] U.S. Cl. ..... 229/402; 229/405; 220/738; 220/739

[58] Field of Search ..... 229/402, 405, 229/117.19, 117.23; 220/738, 739

[56] References Cited

U.S. PATENT DOCUMENTS

| | | | |
|---|---|---|---|
| 2,029,429 | 2/1936 | Koons | 229/402 X |
| 2,032,343 | 3/1936 | Arthur | 229/402 X |
| 2,194,898 | 3/1940 | Hanford | 229/402 X |
| 2,868,434 | 1/1959 | Jones | 229/402 |
| 4,685,583 | 8/1987 | Noon | 229/402 X |
| 5,174,965 | 12/1992 | Jones et al. | 229/402 X |
| 5,205,473 | 4/1993 | Coffin, Sr. . | |
| 5,460,324 | 10/1995 | Vinther | 229/402 X |

*Primary Examiner*—Gary E. Elkins
*Assistant Examiner*—Tri M. Mai
*Attorney, Agent, or Firm*—McGlew and Tuttle

[57] ABSTRACT

A collar flexibly movable between a first shape defining an opening for receiving one end of a cup and a second shape where the collar is substantially flat. A handle is flexibly connected to the collar. Tension members attach to the handle and collar on opposite sides of the handle to provide two opposing forces which prevent the handle from moving with respect to the collar.

19 Claims, 6 Drawing Sheets

BEVERAGE CONTAINER HOLDER AND METHOD OF FORMING

FIELD OF THE INVENTION

This invention relates to beverage containers, and especially those which are disposable.

BACKGROUND OF THE INVENTION

Hot beverage containers have been historically constructed from two materials: polystyrene and wax-coated paper. They both have been well received by fast food industry and its consumers. Wax-coated paper products are becoming more popular in hot beverage industry due to its environmental-friendly properties: they are recyclable and they easily degrade on landfills. Wax-coated paper products, however, have very low insulation qualities.

Polystyrene is not easily recyclable nor biodegradable. It does not degrade easily by the exposure to the environment. It has to be disposed of in sanitary landfills, which are expensive to use. Polystyrene can be also incinerated. That method, however, creates many other environmental problems due to the toxic fumes the material emits during burning. Polystyrene however has excellent insulating properties.

People prefer drinking hot beverages from a mug with a handle. They do not enjoy drinking hot beverages from a glass (or a paper-cup) due to the burning sensation it creates in the hands, especially with a poorly insulated cup.

SUMMARY AND OBJECTS OF THE INVENTION

The primary object of the invention is to provide a simple and inexpensive holder which changes an ordinary disposable cup into a mug with a handle outside of direct contact with a hot beverage. It is another object to provide a holder which stores easily, can be mass produced and can be disposable without significant environment problems.

The object of the invention is achieved by forming a flexible collar movable between a first shape and a second shape. The first shape defines a cup opening for receiving one end of the cup, and the cup opening has a size or configuration to block complete passage of the cup through the cup opening. The second shape of the opening is a folded shape of the collar with the size of the cup opening being substantially reduced. A handle has one part connected to the collar and defines a handle opening for receiving at least one finger of a user. A first tension member has a first end connected to the collar at a location spaced from a first side of the handle, and having a second end connected to the handle at a location spaced from the collar. The first tension member has tension means for applying a first force to the handle when the collar is in the first shape. A second tension member similar to said first tension member is arranged on an opposite side of said handle and applies a second force to the handle when the collar is in the first shape. The first and second forces prevent movement of the handle.

The present invention provides a preferably recyclable handle with a structure to attach it to the ordinary disposable cup or container. The invention is easy and inexpensive to mass-produce, can be adjusted to many sizes of cups or containers and can be produced from various cellulosic materials, such as paper or corrugated recycled material, or any other recyclable materials. Compared to a polystyrene container, a wax-paper container combined with the holder to form a mug has better insulating qualities and is environmentally superior, since it contains elements which are easily recyclable. The use of wax-coated paper in disposable containers can be increased since there would be no need for a good insulator like polystyrene.

A recyclable holder can change an ordinary disposable container to an easier to handle mug. A heavy-duty version of the invention, made out of plastic or wooden handle section combined with a nylon or other strong material collar section can be reused many times and carried for personal use. A single plastic injected form can easily be created to form inject the entire structure from flexible plastic for multiple use. In its heavy duty version the invention is stored by the owner for reusing with disposable containers.

The rigidity of the holder is achieved by a tension member or members attached to the handle and the collar. The structure can be collapsible for flat storage.

The problems associated with paper containers, especially its lack of insulating properties, are overcome by moving a contact point between a hand and a container away from the hot or cold beverage. The holder can be used with a variety of existing beverage containers, including paper cups, polystyrene containers, soup containers, etc. It provides a much preferred way of holding a hot beverage container.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
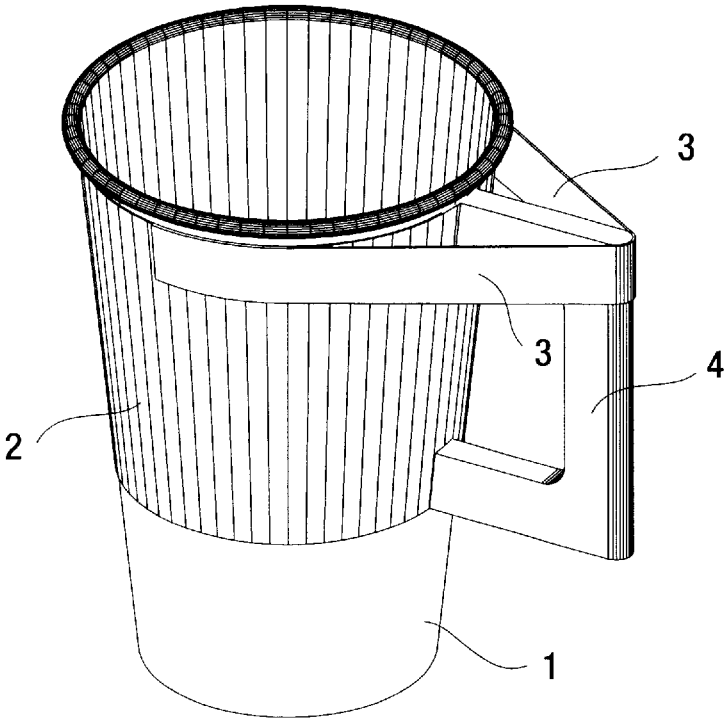
FIG. 1 is a view of the invention fitted around the disposable cup.

Referring to the drawings, and in particular to FIG. 1, the present invention provides beverage container holders which are environmentally friendly and promote use of low-insulating paper beverage containers instead of polystyrene containers.

In FIG. 1 a handle 4 is attached at a first end to a collar 2. The handle 4 is also held in place by a tension member 3 attached to the handle at another end. The tension member 3 is attached, preferably glued, at the ends of the tension member 3 to the collar 2 and glued in the middle of the tension member to the handle 4.

Various shapes of a collar 2 can be used. The full collar 2 is illustrated in FIG. 1 and FIG. 6. The slim version collar is illustrated in FIG. 2 and FIGS. 3–6. Other shapes of collar are possible depending on application.

Several methods of construction of the invention may be used, from a single-material single die-cut version to a multiple elements (collar, handle, tension members) created from the same or different materials and joined together.

The preferred material used for the production of the invention is paperboard, corrugated paper, kraft or other easily recyclable cellulosic material, or a combination of the above. At least one side of the collar is in direct contact with the beverage container and is desirably treated with water-resisting or water-proofing agent.

Figure 3:
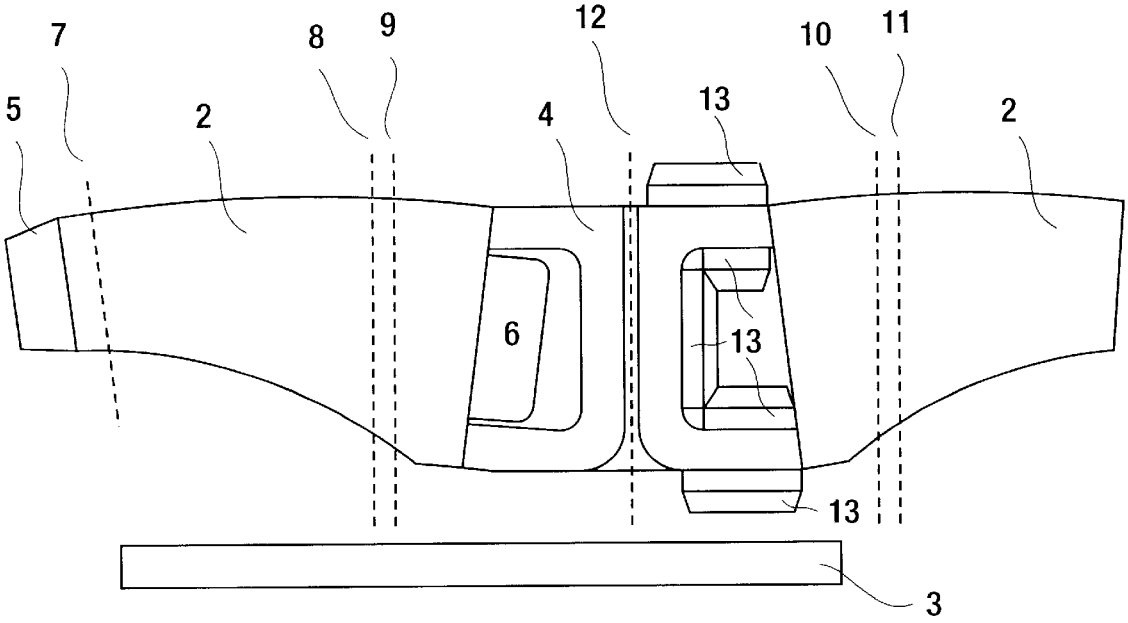
FIG. 3 is a view of a die-cut used for cutting parts for assembly of a beverage holder.

In a preferred embodiment of the invention a piece of cellulosic material is die-cut, folded and glued to create a handle with the collar and tension member attached to the handle. In FIG. 3, the holder is shown as a form which has just been cut out of a larger material, and before the holder is fully assembled. Tabs 13 are folded and glued to form a square tubular section of the handle. The entire form is folded around a small cylinder at fold line 12. A flap 6 is glued to the opposite side of the collar 2. The collar section is formed by folding left section of collar 2 around folding line 7 and gluing tab 5 to the right section of collar 2 in FIG. 3. The width of the entire element is reduced by two folds for each side of the collar, along folding lines 8 and 9, and 10 and 11. These fold lines 8–10 can be offset from each other cause the flattened holder to lie thinner. Finally, a tension strap 3 is folded in half and glued on both ends to the respective sides of collar 2 and glued to the handle at midsection of strap 3, preferably at the top of the handle. The form can be stored flat and expands to the shape illustrated in FIG. 1 by pulling or holding of the handle 4 while inserting a disposable cup into the center of collar 2. This expands the collar and places the tension members 3 into tension between the collar 2 and handle 4. The tension force from members 3 in cooperation with the compression resistance of the handle 4 holds the handle centered on the collar in a very secure manner, and provides a sturdy connection of the handle 4 to the collar. The collar 2 is held to the cup 1 due to the taper of the cup trying to expand the collar 2 and the cup not being able to further expand the collar past a predetermined point. This prevents the cup from further passing through the collar when the holder is lifted around the cup by the handle. Friction between the cup and the collar holds the collar to the cup once the cup has been tightly inserted into the collar. The circumference of the collar can also be made smaller than a rim of the cup, to prevent the entire cup from passing through the collar when the collar is lifted.

Figure 2:
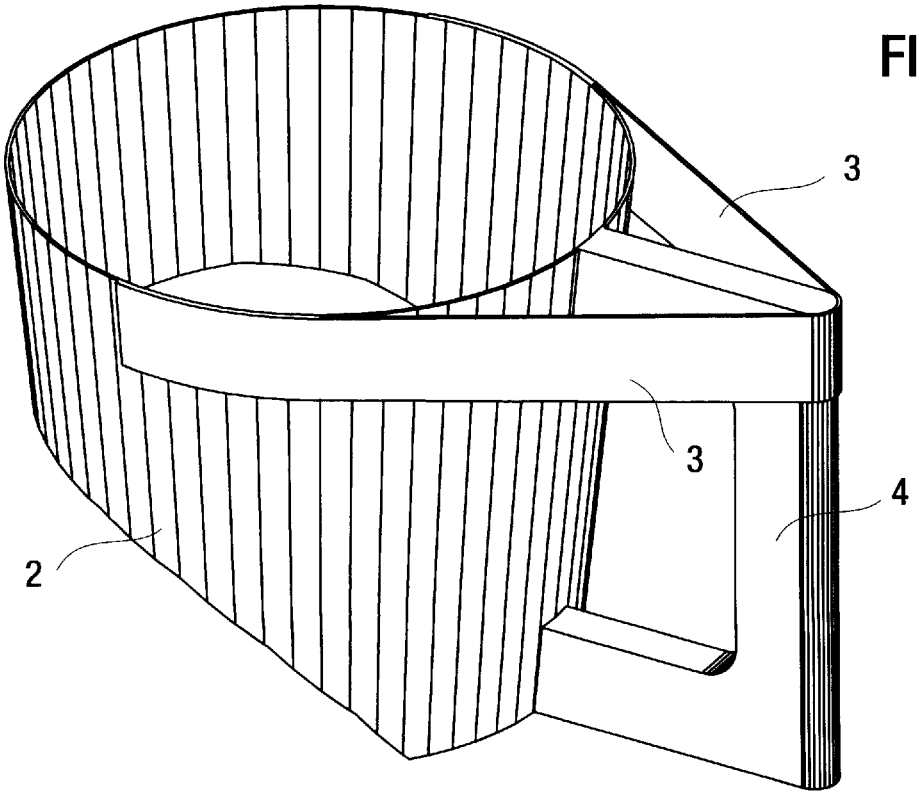
FIG. 2 is a view of the invention without the cup.
Figure 4:
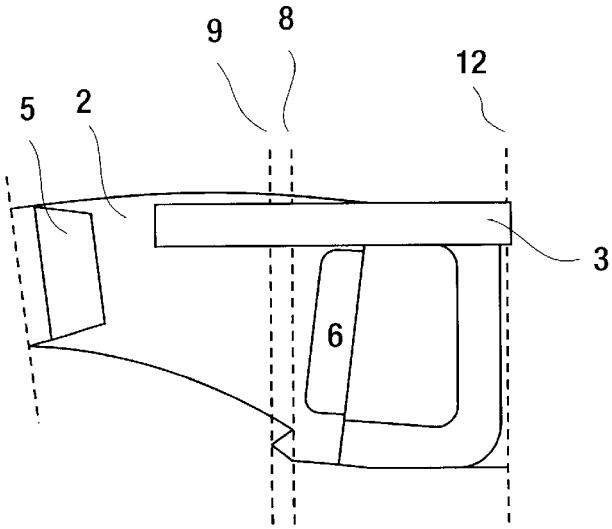
FIG. 4 is a view of the invention die-cut, folded and glued.

FIG. 4 illustrates the view of a folded and glued beverage container handle. Tension strap 3 is glued flat to the collar 2 and the handle 3. Collar 2 is folded at folding lines 8 and 9 resulting in reduced overall width of the form, and allowing the collar 2 to be folded flat from the expanded shape shown in FIGS. 1–2, without collapsing the handle or breaking the tension member. In FIGS. 1–2 the fold would be in the collar area between where the tension member 3 contacts the handle 4 and where the tension member 3 contacts the collar 2.

Figure 5:
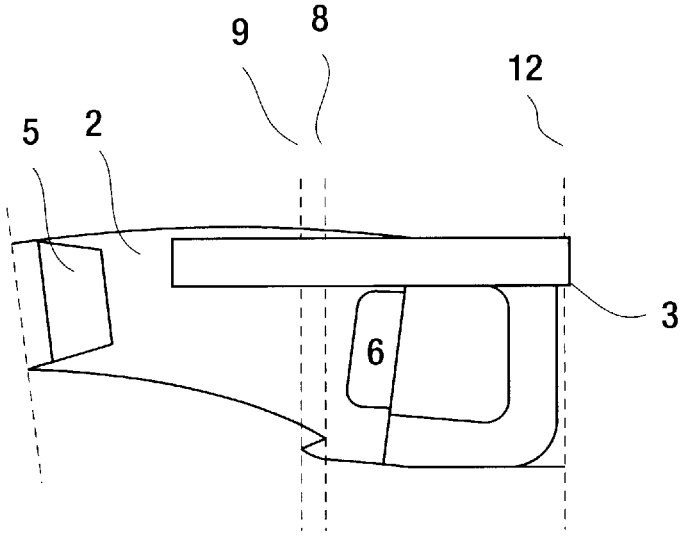
FIG. 5 is a version of the invention with a small handle size
Figure 6:
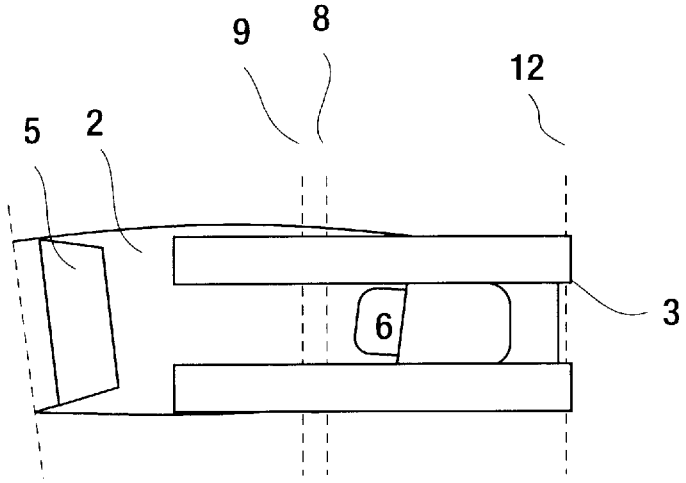
FIG. 6 is a version of the invention with a "single finger" handle suitable for car cup holders requiring long bottom part of the cup.

In another preferred embodiment of the invention illustrated in FIG. 5 the handle is smaller to fit 2 fingers with similar structure to that as illustrated in FIG. 4.

In another preferred embodiment of the invention illustrated in FIG. 6 the handle is formed smaller to fit a single finger, allowing a cup with a handle to fit standard car cup holders. Additionally, FIG. 6 illustrates a variation of a handle with multiple tension straps, one on the top and one on the bottom of the handle.

Figure 7:
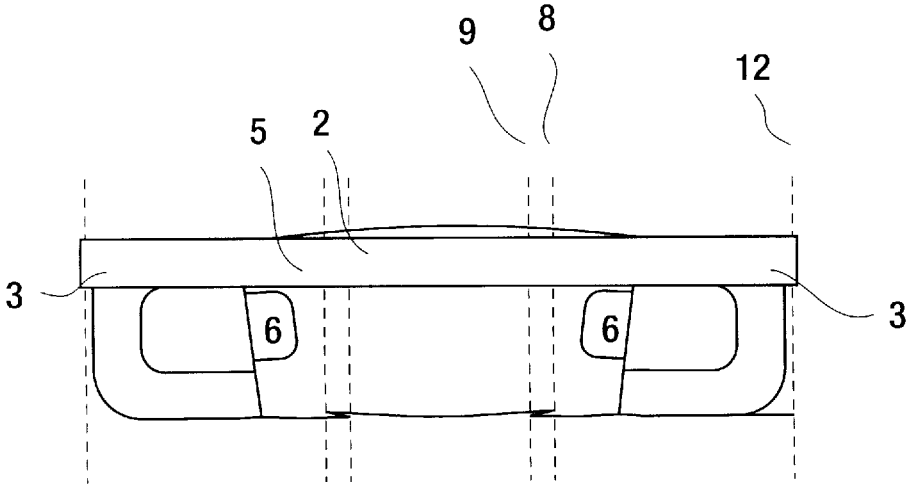
FIG. 7 is a version of the invention for soup bowls with double handle and corresponding double tension members.

In another preferred embodiment of the invention illustrated in FIG. 7, two handles 4 are attached to the collar with multiple tension members 3 for a two-hand holder design suitable for soup containers. Two die-cut elements from FIG. 3 with half of their collar sections are combined to form two-handle holder.

Figure 8:
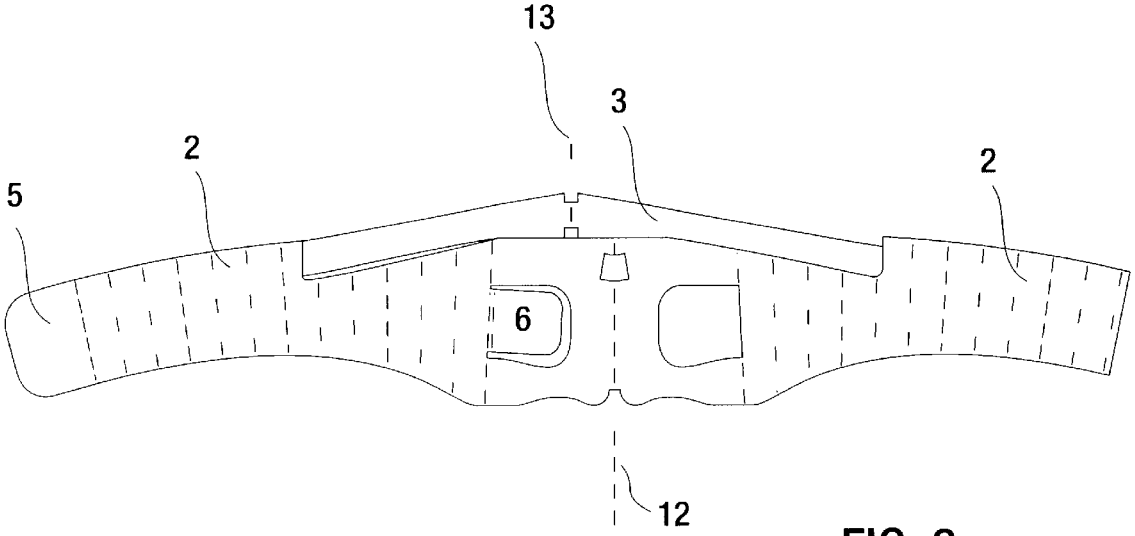
FIG. 8 is a view of a die-cut used for cutting a single part with a collar, a tension member, and a handle sections
Figure 9:
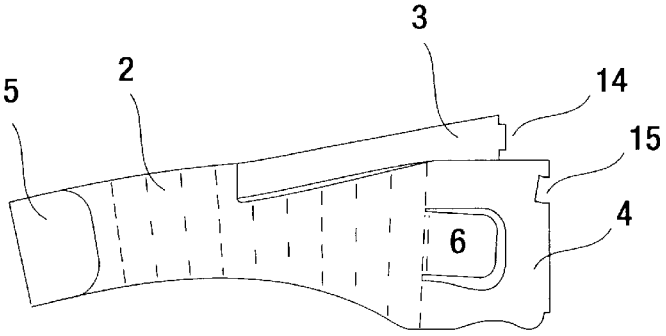
FIG. 9 is a view of the die cut of FIG. 8 after it has been folded and glued.

In another preferred embodiment of the invention illustrated in FIG. 8, a single piece of material is die-cut to form a collar, a handle, and a tension member. The collar/handle section is folded around folding line 12, the tension member section is folded around a folding line 13. The resulting flat structure illustrated in FIG. 9 can be expanded to a shape similar to that in FIG. 1 by opening the collar section and fitting a part 14 of a tension member 3 into a cut 15 at the top of the handle 4.

Figure 10:
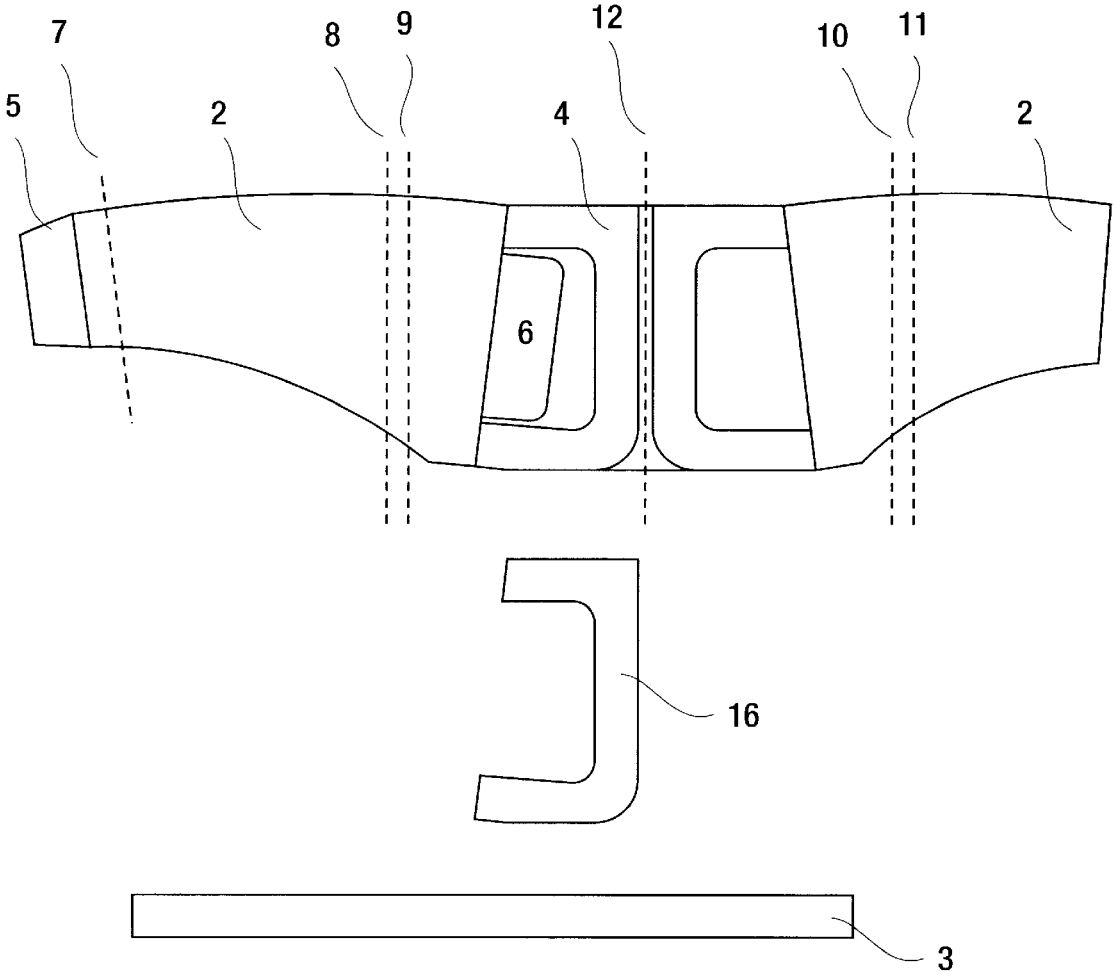
FIG. 10 is a view of elements of the invention containing an additional handle part to increase its thickness and rigidity.

In another preferred embodiment of the invention illustrated in FIG. 10, several different materials can be combined to construct a beverage container holder. For example, a handle part 16 could be cut from a thicker corrugated material. The handle is then glued to a thinner handle section 40 and the combined form folded and glued as per FIG. 4.

Figure 11:
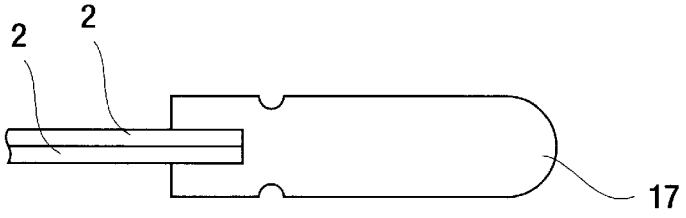
FIG. 11 is a top view of a separate handle assembled with a collar part.

In another preferred embodiment of the invention right and left handle section 40 of FIG. 10 can be omitted and replaced with a separate handle 17 which connects directly to the collar 2, as shown in FIG. 11 with the collar 2 folded flat. To fit this embodiment to the cup the collar 2 is expanded and tension straps are fitted to the separate handle 17 and the collar.

Figure 12:
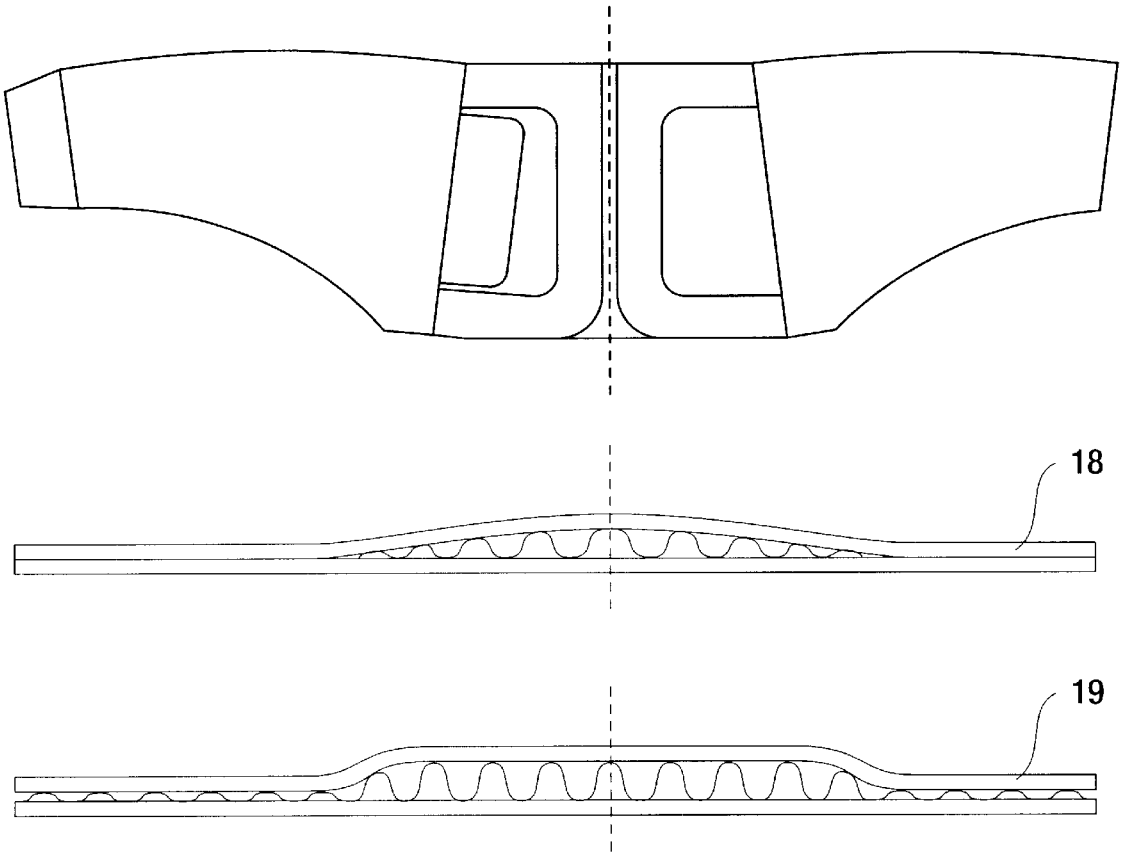
FIG. 12 is a side view of variable thickness materials used to produce the invention.

In another preferred embodiment of the invention a various thickness material 18 is cut to create the form that is then folded and glued to form the holder, as is illustrated in FIG. 12. The resulting beverage cup holder has a thick handle and thin collar sections. A constant thickness material, such as thin corrugated board illustrated in 19 of FIG. 12 can be pressed on both sides of the handle section to produce a thick handle section and a thin flexible collapsed collar section.

Figure 13:
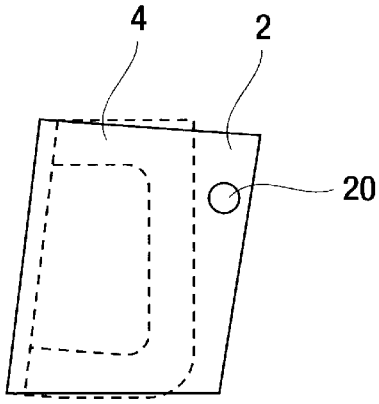
FIG. 13 is a side view of a folded heavy-duty reusable version of the invention

In another preferred embodiment of the invention illustrated in FIG. 13 a wooden or plastic handle is combined with a nylon or other fabric collar and tension member sections. This very flexible form is easily stored wrapped around the handle and held in position using a simple clip 20 or hook and loop fastener. This flexible form can be form-injected from a single form using flexible plastic. Due to the flexibility of the collar section in this version double tension members would be recommended for that design.

The features described in the abstract, the patent claims, the description and those features presented in the drawing can prove essential both singly and in arbitrary combinations to the realization of the invention.

While specific embodiments of the invention have been shown and described in detail to illustrate the application of the principles of the invention, it will be understood that the invention may be embodied otherwise without departing from such principles.

What is claimed is:

1. A holder for a cup, the holder comprising:

a flexible collar movable between a first shape and a second shape, said first shape defining a cup opening for receiving one end of the cup, said cup opening having a size to block complete passage of the cup through said cup opening, said second shape being a folded shape of said collar with said cup opening being substantially reduced as compared to said first shape;

a handle having one part being directly connected to said collar;

a first tension member having first end connected to said collar at a location spaced from a first side of said handle, said first tension member having a second end connectable to said handle at a first handle location spaced from said collar when said collar is formed into said first shape, said first tension member having tension means for applying a first force to said handle when said collar is in said first shape;

a second tension member having a first end connected to said collar at a location spaced from a second side of said handle, said second tension member having a second end connectable to said handle at a second handle location spaced from said collar when said collar is formed into said first shape, said second tension member having tension means for applying a second force to said handle when said collar is in said first shape, said first and second forces preventing movement of said handle.

2. A holder in accordance with claim 1, wherein:

said first and second tension members are disconnectable from said handle when said collar is formed into said second shape.

3. A holder in accordance with claim 1, wherein:

said first and second tension members have means for being repetitively connectable to and disconnectable from said handle in respective said first and second shapes of said collar without significant damage to said handle and said first and second tension members.

4. A holder in accordance with claim 1, wherein:

said first force is in a direction away from said first side of said handle;

said second force is in a direction away from said second side of said handle.

5. A holder in accordance with claim 1, wherein:

said first and second sides are on opposite sides of said handle.

6. A holder in accordance with claim 1, wherein:

said first ends of said tension members are connected to said collar on opposite sides of said handle.

7. A holder in accordance with claim 1, wherein:

said first and second tension members are combined into a one piece tension member, a middle portion of said one piece tension member is connectable to said handle when said handle is formed into said first position, and ends of said one piece tension member are connected to said collar on opposite sides of said handle.

8. A holder in accordance with claim 1, wherein:

said handle, said collar and said tension members are all formed from flexible material.

9. A holder in accordance with claim 1, wherein:

said handle, said collar and said tension members are all formed in one piece from a single material.

10. A holder in accordance with claim 9, wherein:

a thickness of said single material is greater in an area of said handle than in an area of said collar.

11. A holder in accordance with claim 1, wherein:

said handle is flexibly connected to said collar.

12. A holder in accordance with claim 1, wherein:

said second shape of said collar is substantially flat.

13. A holder in accordance with claim 1, wherein:

said second shape of said collar has substantially opposite inside sides of said opening touching each other.

14. A holder in accordance with claim 1, wherein:

said handle defines a handle opening of a size to receive at least one finger of a user.

15. A holder in accordance with claim 1, wherein:

said handle is graspable by a user.

16. A holder in accordance with claim 1, wherein:

said first and second handle locations are adjacent.

17. A holder in accordance with claim 1, wherein:

said first and second handle locations are combined into one location.

18. A holder in accordance with claim 1, wherein:

said first and second forces maintain said handle substantially in place.

19. A holder for a cup, the holder comprising:

a flexible collar movable between a first shape and a second shape, said first shape defining a cup opening for receiving one end of the cup, said cup opening having a size to block complete passage of the cup through said cup opening, said second shape being a folded shape of said collar with said cup opening being substantially reduced as compared to said first shape;

a handle having one part being connected to said collar;

a first tension member having first end connected to said collar at a location spaced from a first side of said handle, said first tension member having a second end connectable to said handle at a location spaced from said collar when said collar is formed into said first shape, said first tension member having tension means for applying a first force to said handle when said collar is in said first shape;

a second tension member having a first end connected to said collar at a location spaced from a second side of said handle, said second tension member having a second end connectable to said handle at a location spaced from said collar when said collar is formed into said first shape, said second tension member having tension means for applying a second force to said handle when said collar is in said first shape, said first and second forces preventing movement of said handle, said first and second forces apply a compression force to said handle, and said handle has means for resisting said compression force.

* * * * *